US006286581B1

(12) United States Patent
Gustafson

(10) Patent No.: US 6,286,581 B1
(45) **Date of Patent: *Sep. 11, 2001**

(54) METHOD FOR MACHINING SAND BLOCK INTO SAND MOLDING ELEMENTS INCLUDING SAND MOLDS AND SAND CORES FOR METAL CASTING FOUNDRY OPERATIONS

(76) Inventor: Ronald Gustafson, 2503 Harlem Blvd., Rockford, IL (US) 61103

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/363,128

(22) Filed: Jul. 28, 1999

(51) Int. Cl.[7] ..... B22C 9/02
(52) U.S. Cl. ..... 164/17
(58) Field of Search ..... 164/17, 456

(56) References Cited

U.S. PATENT DOCUMENTS

| | | | | |
|---|---|---|---|---|
| 3,101,516 | * | 8/1963 | Hokkeling | 164/17 |
| 3,387,645 | * | 6/1968 | Van Beckhoven | 164/17 |
| 4,104,347 | * | 8/1978 | Ohashi et al. | 164/17 |

FOREIGN PATENT DOCUMENTS

| | | | | |
|---|---|---|---|---|
| 3824388 | * | 6/1977 | (DE) | 164/17 |
| 52-22807 | * | 6/1977 | (JP) | 164/17 |
| 54-66326 | * | 5/1979 | (JP) | 164/161 |
| 59-166350 | * | 9/1984 | (JP) | 164/15 |
| 61-172650 | * | 8/1986 | (JP) | 164/17 |
| 899237 | * | 1/1982 | (SU) | 164/17 |

OTHER PUBLICATIONS

Newscast website pages (printed Sep. 8, 1999) (3 pages).
Brochure entitled "Clinkenbeard, Rapid Solutions To Today's Manufacturing Challenges," , undated.
Article entitled "Rapid Prototyping: A Tool for Casting Design and Verification," published in Modern Casting, Mar. 1999.

* cited by examiner

*Primary Examiner*—James P. Mackey
(74) *Attorney, Agent, or Firm*—Leydig, Voit & Mayer, Ltd

(57) ABSTRACT

A method for machining a sand core, a cope, a drag or other molding element from a block of sand held together by binder material for use in foundry metal casting operations. The sand block is cut preferably with a diamond or carbide cutting bit of a computer numerical controlled (CNC) machine tool to cut a pattern into the sand block. A machine tool may be a mill, lathe, drill press, or other machine tool as appropriate. The sand block may be clamped in a variety of positions, and reference points are used to locate the sand block during each subsequent clamping and reclamping of the sand block to the various machine tools. The machined sand core is then inserted into a mold and used in foundry operations to create an internal cavity in a metal casting.

23 Claims, 10 Drawing Sheets

METHOD FOR MACHINING SAND BLOCK INTO SAND MOLDING ELEMENTS INCLUDING SAND MOLDS AND SAND CORES FOR METAL CASTING FOUNDRY OPERATIONS

FIELD OF THE INVENTION

The present invention generally relates to metal casting foundry operations, and more particularly, to methods for forming sand cores, sand molds or other molding elements for use in metal casting foundry operations.

BACKGROUND OF THE INVENTION

Sand molds typically comprise upper and lower shells (often referred to as a cope and a drag) which provide a hollow internal compartment therebetween to form the external shape of a simple metal casting. Frequently it is desired that the metal casting contains an internal cavity, such as a fluid passageway for example. Anyone can see at a glance that a metal casting cavity contains nothing. As such, special forms known as sand cores are used to shape the interior design of a metal casting. The core, thus, merely defines the shape during molten metal filling by preventing the flowing metal from occupying this space. After the mold has solidified, the core is destroyed at shakeout, leaving only the correctly shaped casting cavity. The sand mold including the cope and the drag, as well as internal cores can be generally characterized as molding elements.

A foundryman can also use a core to shape the external part of the more intricate casting. For instance, if a section of the casting is an undercut, a core can be used for section, so that the pattern can be withdrawn from the mold without distorting the mold. Besides forming internal cavities surrounded by metal, or some external surfaces of an intricate casting, a core is sometimes used to strengthen or improve a particular inner or outer surface of the mold.

Some of the typical requirements of molding elements are that they are workable in moldings and have sufficient bench life, that they are able to vent off gases during molten metal pouring and cooling operations, and that they are able to have good collapsibility such that the sand shakes out well once the metal is cooled to expose the metal casting and any internal cavities in the metal casting. As such, copes, drags and cores are typically made of dry, free-flowing sand. Special binders are added to the sand to hold the sand together in the desired shape, and generally give the individual molding element its name. For example, the following types of sand/binder materials have been used for molding elements in metal casting foundry processes: green sand, hot box, oil bonded, furan (no bake), shell, cold box, sodium silicate $CO^2$, and others.

In high volume production, foundrymen form the separate sand-shaped cores by compacting a special sand mixture in a core box. The core box is a specially designed structure, the cavity of which is shaped like the core to be made. Copes and drags are typically made in a special machine that includes a matchplate that occupies the internal hollow compartment between the cope and the drag while the mold is being formed.

While the above-described method for making molding elements works very well for high volume production, it has several drawbacks with regards to making single prototypes or low volume production of metal castings where turn around time is absolutely critical. Manufacturers who use metal castings are in constant competition to see who can get a new product to the marketplace the quickest. Manufacturers which have their new product to the marketplace first can gain a significant commercial advantage.

Manufacturers often make their decision on where to out source a cast metal prototype component based on the quoted turn around time. Conventional methods of casting production, including the construction of tooling and the pouring a casting, are often too time-exhaustive to provide a metal model to a company for verification of the component's shape and its fit in the overall end product design. As such some manufacturers do not even create actual metal castings but simply rely on various other rapid prototyping methods that have evolved for design verification before a casting is poured. Rapid prototyping methods can make the process of "printless" tooling and casting quotation easier and more accurate. For example, various rapid prototyping processes such as Fused Deposition Modeling (FDM), Laminated Object Manufacturing (LOM), Selective Laser Sintering (SLS), Solid Ground Curing (SGC), Stereolithography (SLA), Three dimensional Printing (3DP), Direct Shell Production Casting (DSPC), have been used to create prototypes. However, these methods are still more time consuming than desired or have practicality limitations. Moreover, many of these methods only produce wax, plastic or paper/woodlike prototypes, which are insufficient for most laboratory testing. Even machining a metal prototype will yield a prototype with different precision qualities and strength qualities as compared with a cast metal prototype.

Despite the recent advances in computer-based simulations of casting solidification, many manufacturers still require prototypes of metal castings to be tested before approval is given for mass production. Moreover, actual metal castings are usually desired in any event due to the extreme costs of making changes after a design is released for production or even into the marketplace. For the foundry and the manufacturer, the verification of a cast metal component before full production is vital to reducing lead times and total costs. For example, the costs of changing the basic design of a product increase rapidly as the design advances through the development cycle. The development cycle can generally be categorized in the following five (5) steps, including: conceptual modeling, detailed design, prototype/test, manufacturing, and product release. Making changes during the conceptual modeling stage is by far the cheapest, while changes at the product release stage are by far the most expensive. It has been estimated that the cost of making changes increases tenfold for each different step during the process. For example, if a change was to be made during conceptual modeling which costs one dollar, the same change made during the prototype/test stage would be a hundred dollars, and at the manufacturing time, one thousand dollars, and at the product release stage, ten thousand dollars. Therefore, the quicker a prototype can be made for use in testing or verification, the more changes a manufacturer can make to a metal casting before it is manufactured or released into the marketplace.

The problem is that the production of hard tooling (such as metal dies for die casting, permanent molding, and investment wax for injection, or cope/drag tooling to which the long sand casting production runs) often do not meet the manufacturer's desired lead time requirements, for example, a shipment of a hundred prototype castings for use in three (3) weeks. Even with these advances in rapid prototyping processes, manufacturers are still not satisfied with the requisite time it takes to obtain a cast metal prototype for use in testing, or a test market. The common method to form these metal casting prototypes is to use one of the rapid prototype patterns (for example a woodlike prototype made by the LOM process) that is durable enough to survive the sand molding process and can be used directly as a master pattern to make sand mold elements. Rapid prototype core boxes can be used to make the cores that are filled with sand manually, rather than with a core blower.

Currently, there is not a quick enough turnaround time in industry with regards to making metal castings. Moreover, precision can be lost in the making of sand molds from plastic, wax or woodlike prototypes and core boxes formed by from a wood-like, plastic or wax prototype or other appropriate prototype made via a rapid prototyping process. Moreover, the sand can settle or change shape after being formed in the core box and allowed to cure, which also slightly changes the shape of the core box and results in less precession. This also is likewise undesirable.

SUMMARY OF THE INVENTION

It is therefore an object of the present invention to overcome these and other disadvantages and problems existing out there in the art.

It is a specific object of the present invention to provide faster methods for forming prototype or low volume metal castings to provide quicker turn around times for prototype or low volume metal castings.

It is another object of the present invention to provide a faster way to form sand mold elements such as a cope, a drag, a core, or other such sand pattern type items for use in foundry molds to produce prototype or low volume metal castings.

It is another object of the present invention to provide a more precise way to form metal castings.

In accordance with these and other objectives, the present invention is directed at a method of machining blocks of sand into sand mold elements such as sand cores, copes and drags for use in foundry processes to form metal castings. The block of sand is held together by conventional foundry binder material and is machined with a machine tool to the desired pattern of the sand mold element. Preferably, the sand block is machined, using computer numerical control (CNC) machining to form the sand block into the desired pattern. CNC machining utilizes readily obtainable CAD files or other computer readable files that can be used for the design of the metal casting. It is an advantage that this eliminates the need to form woodlike paper, plastic, or wax prototypes. A significant advantage of the present invention is that the turnaround time and cost of producing metal castings is significantly reduced.

According to the preferred embodiment, a sand block is clamped into a machine tool such as a mill, a lathe, a drill, or other similar machine tool. The block may be clamped into a stationary position or may be adapted to move or rotate. A cutting tool is then used to remove sand from the sand block to form the desired mold element pattern. Preferably, the pattern is roughed out with a roughing tool, and then finished to a high degree of precision with a finishing tool. The sand block may be unclamped and reclamped if necessary to perform machining for multiple sides or to perform machining with multiple machine tools. Locating pins, may be used in the sand block to maintain alignment of the core when it is being unclamped and reclamped. All of the sand mold elements including the cope, the drag and the internal cores if necessary may be formed by this method. Once the sand mold elements are formed, the sand core is inserted into a prepared mold which includes a cope and a drag. The common use of a machined sand core is to form internal cavities such as fluid passageways and the like inside of the metal casting. The common use of machined sand copes and drags is to form the external surface of the metal casting. Cores may also be used to form external structural features. Once the sand mold is complete, molten metal is poured into the mold and allowed to cool. Once the metal is sufficiently cooled and hardened, the cope, the drag and the core are destroyed at shakeout, thereby leaving only the correctly shaped metal casting along with any internal cavities in the metal casting.

Other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
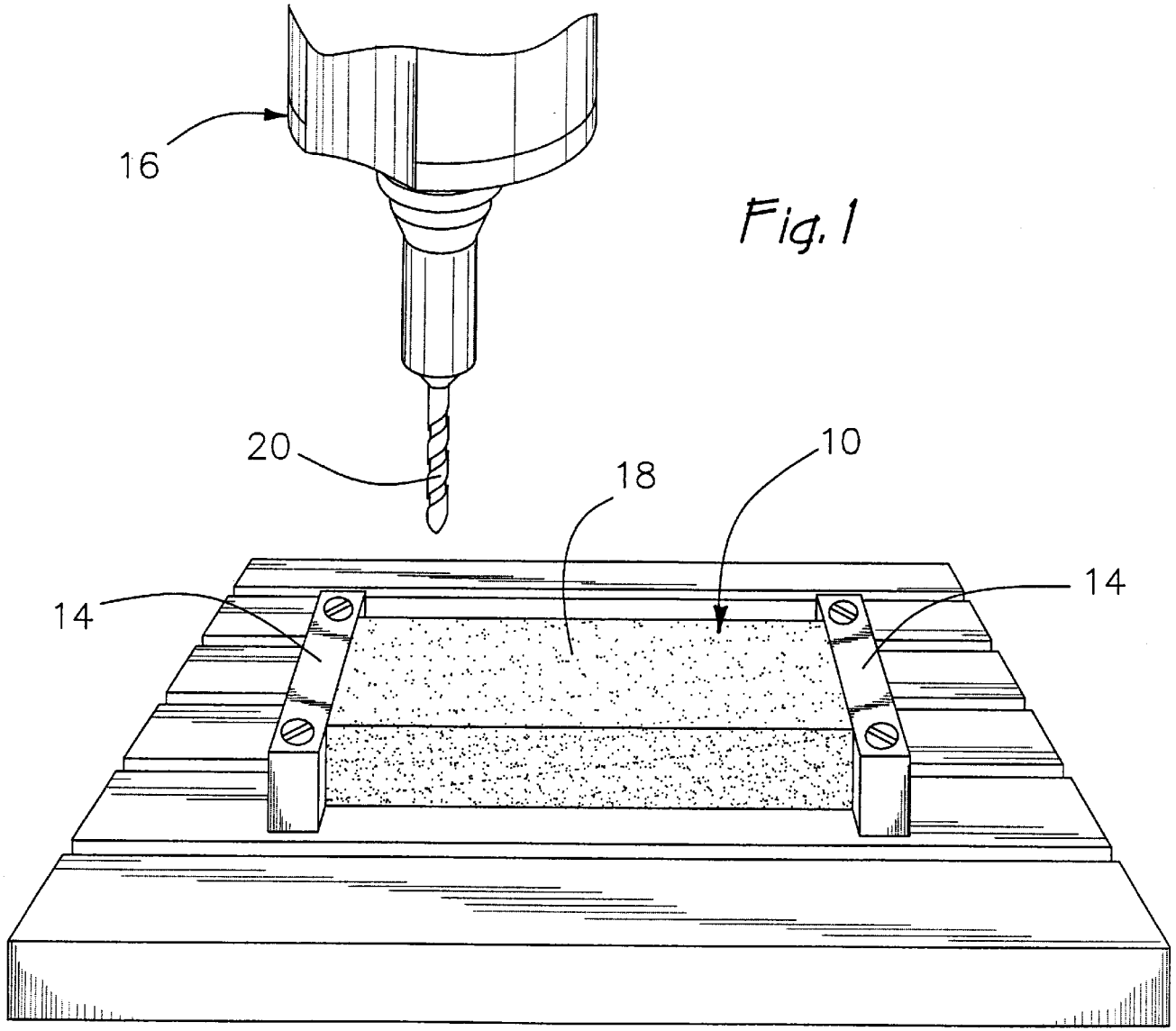
FIG. 1 is a perspective view of a sand block clamped to a machine tool.

For purposes of illustration, a method of machining a sand block 10 held together by conventional binder material into a sand core 12 for use in foundry metal casting operations is shown in sequence in FIGS. 1–10. Although the process will be described in relation to a method for forming a sand core, it will be understood that the same process applies to forming a cope or drag and other such similar sand molding elements for forming metal castings. Referring to FIG. 1, the sand block 10 is secured between clamps 14 of a machine tool 16. The machine tool may be a mill, a drill press, a lathe, a grinder, or other machine tool as appropriate. The sand block 10 is formed from conventional foundry sand material that is held together by binder material. The sand block 10 is formed larger than the intended core 12 to be formed such that the process can generally be categorized as a subtractive process, and not an additive process. The sand is generally dry, free-flowing sand, while the binder added to the sand at the mixer generally gives the individual process or sand block its name. Any type of sand block held together by foundry type binder material as used in conventional foundry operations is sufficient for the purposes of the present invention. Such names of the molding elements include for example, green sand, hot box, oil bounded, furan, (no bake) shell, cold box, sodium silicate $CO^2$, and others as appropriate.

As shown in FIG. 1, the topside 18 of the sand block 10 is facing the cutting bit 20 of the machine tool 16. Preferably, the cutting bit 20 is made from carbide or includes diamond cutting edges, such that the life of the cutting tool is longer due to the hardness of the glass in the sand material. Steel cutting tools can also be used, but it has been found that the life span of steel cutting tools is much less than diamond or carbide type cutting tools.

Figure 2:
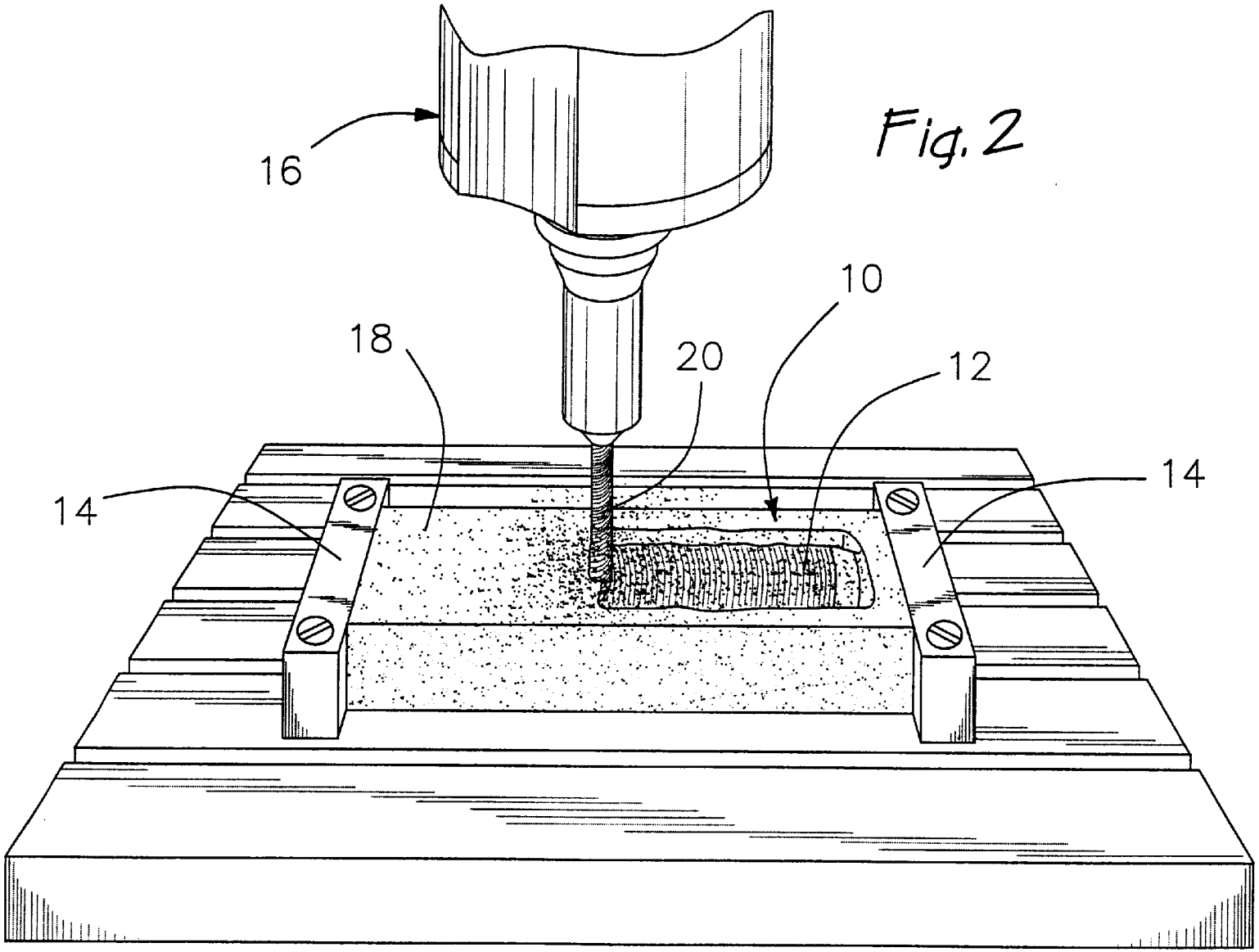
FIG. 2 is a perspective view of the topside of the sand block of FIG. 1 being machined in a roughing operation.
Figure 3:
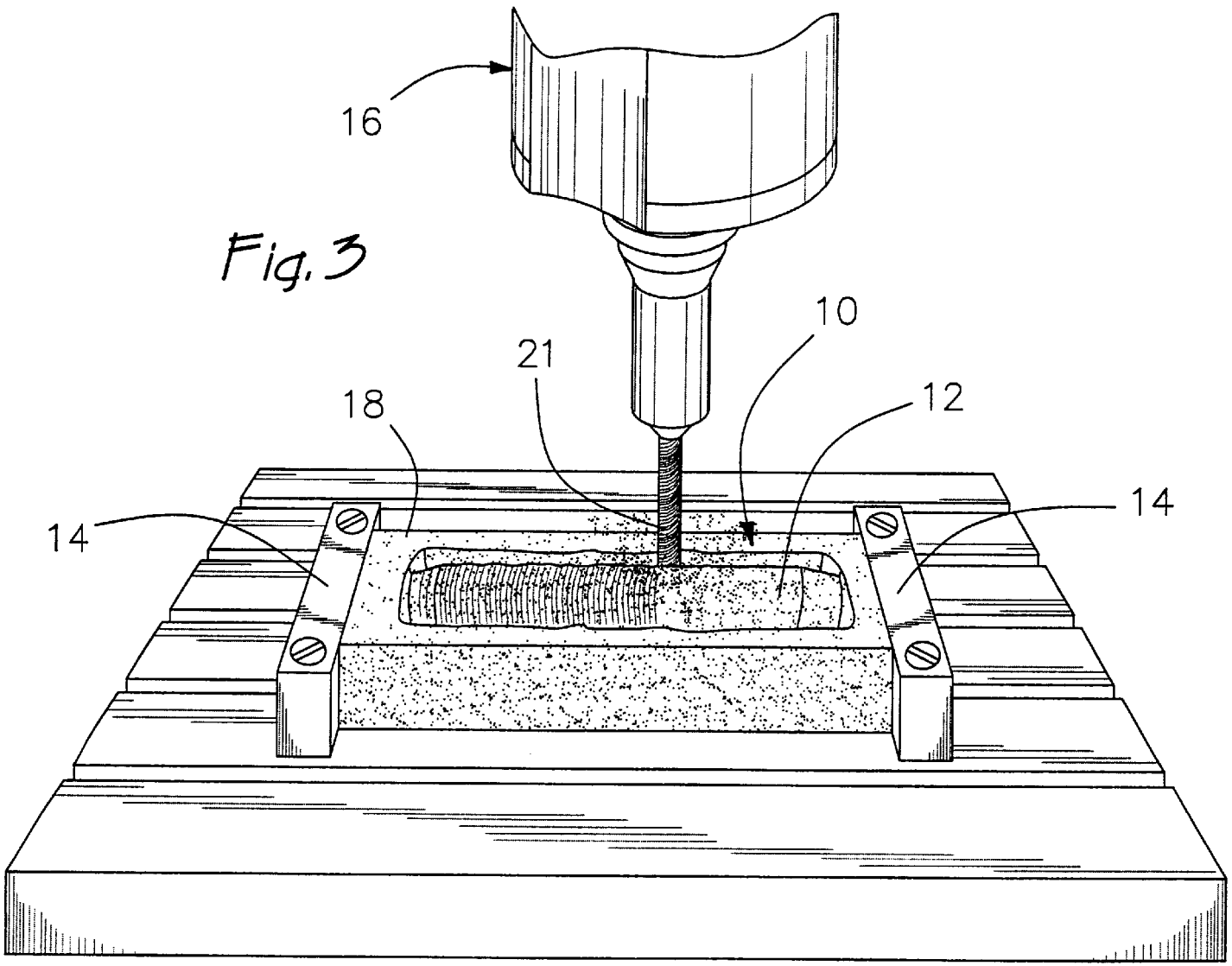
FIG. 3 is a perspective view of the sand block being machined in a finishing operation.
Figure 4:
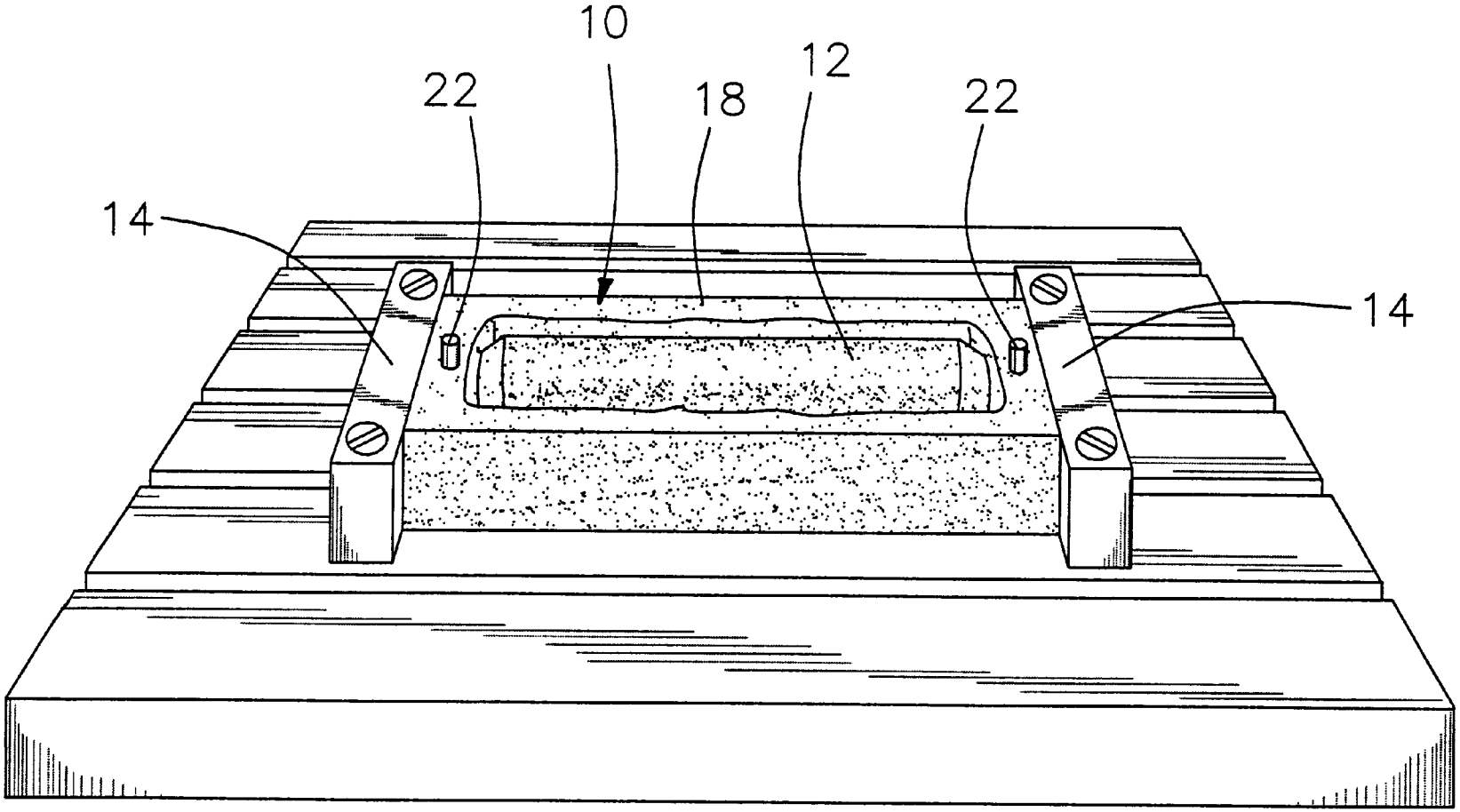
FIG. 4 is a perspective view of the sand block with the topside finished and locating pins inserted to act as reference points.

Referring to FIG. 2, the cutting tool 20 is worked into the topside 18 of the sand block 10 to remove material therefrom and start to form the pattern of the sand core 12. Preferably, the pattern is first roughed out as shown in FIG. 2 with a roughing cutting bit 20 and then finished to a high degree of precision with a finishing cutting bit 21 as can be seen with reference to FIGS. 3 and 4.

In accordance with an aspect of the present invention, the machine tool 16 is preferably computer numerically controlled (CNC) driven, such that the tool 20 is automatically driven based on computer-aided design (CAD) or other computer readable drawing files. In this manner, the pattern formed on the core 12 by the machine tool 16 corresponds to the dimensions of an internal cavity or other projection or structure on a cast metal work piece as intended to be formed from the CAD or other computer, readable drawing files. This is accomplished by inputting a computer readable file into the machine tool 16 and then CNC controlling the machine tool 16 in a conventional manner. Advantageously, this results in a high degree of precision resulting in a mold that will form a metal casting which is identical to the drawing drafted by the engineer. It is also an advantage that the sand molding element may be formed right after the computer aided drawing is complete, thereby achieving a significant time savings. Alternatively, or addition, the sand block 10 may also be worked manually through manual control of the machine tool 16.

Once the machining is complete on the top side 18 of the sand block 10, locating pins 22 or other reference points as conventional in the machine tool art may be used to reference the position of the pattern formed into the top side 18 such that the sand block 10 can be unsecured from the clamps 14 and removed for further machining either to a different machine tool or in this case, on the same machine tool 16, but with the cutting bit 20 directed to the bottom side 24 of the sand block. 10.

Figure 5:
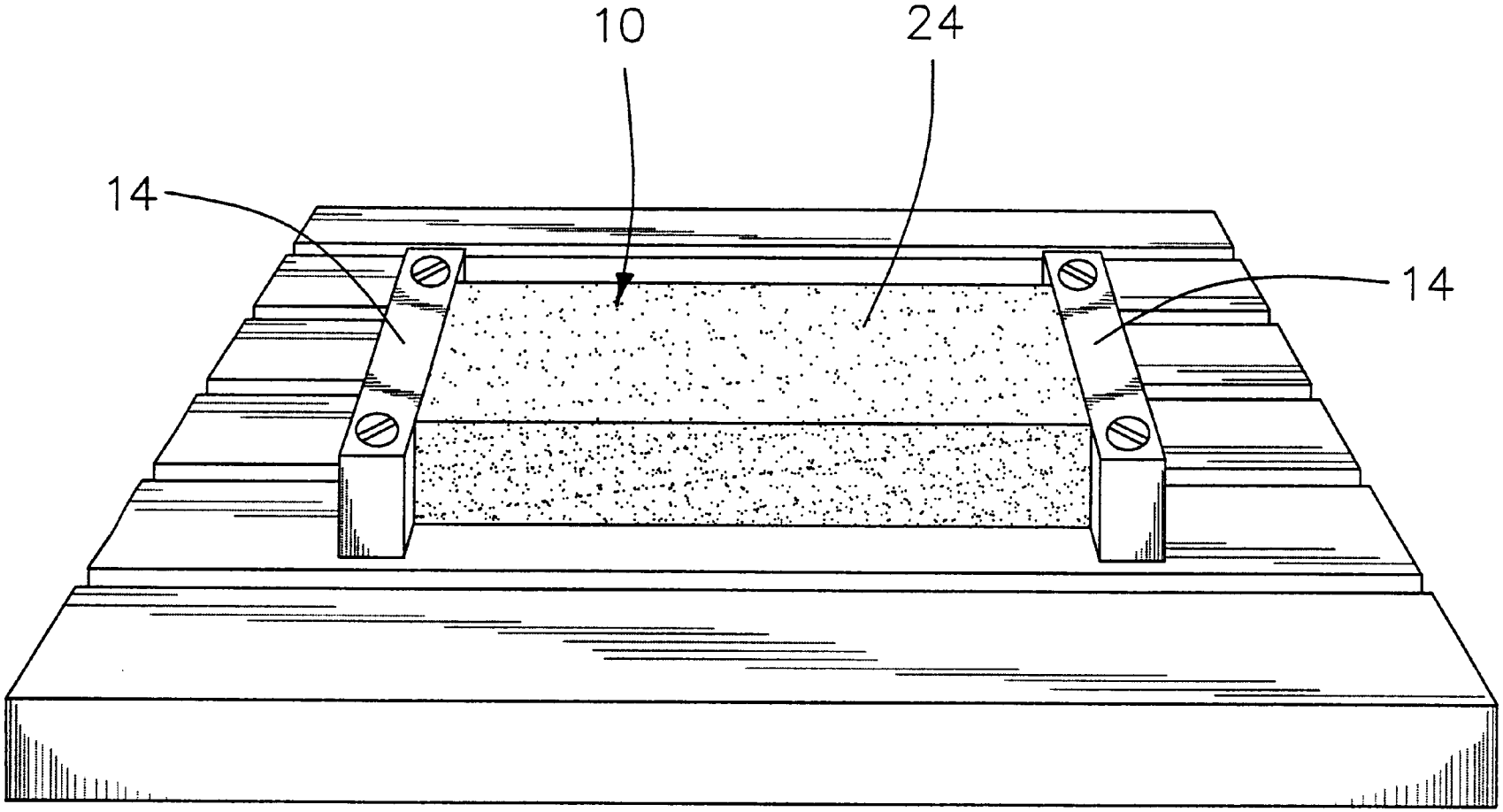
FIG. 5 is a perspective view of the sand block rotated 180 degrees and clamped again to expose the bottom side for a second machining operation.
Figure 6:
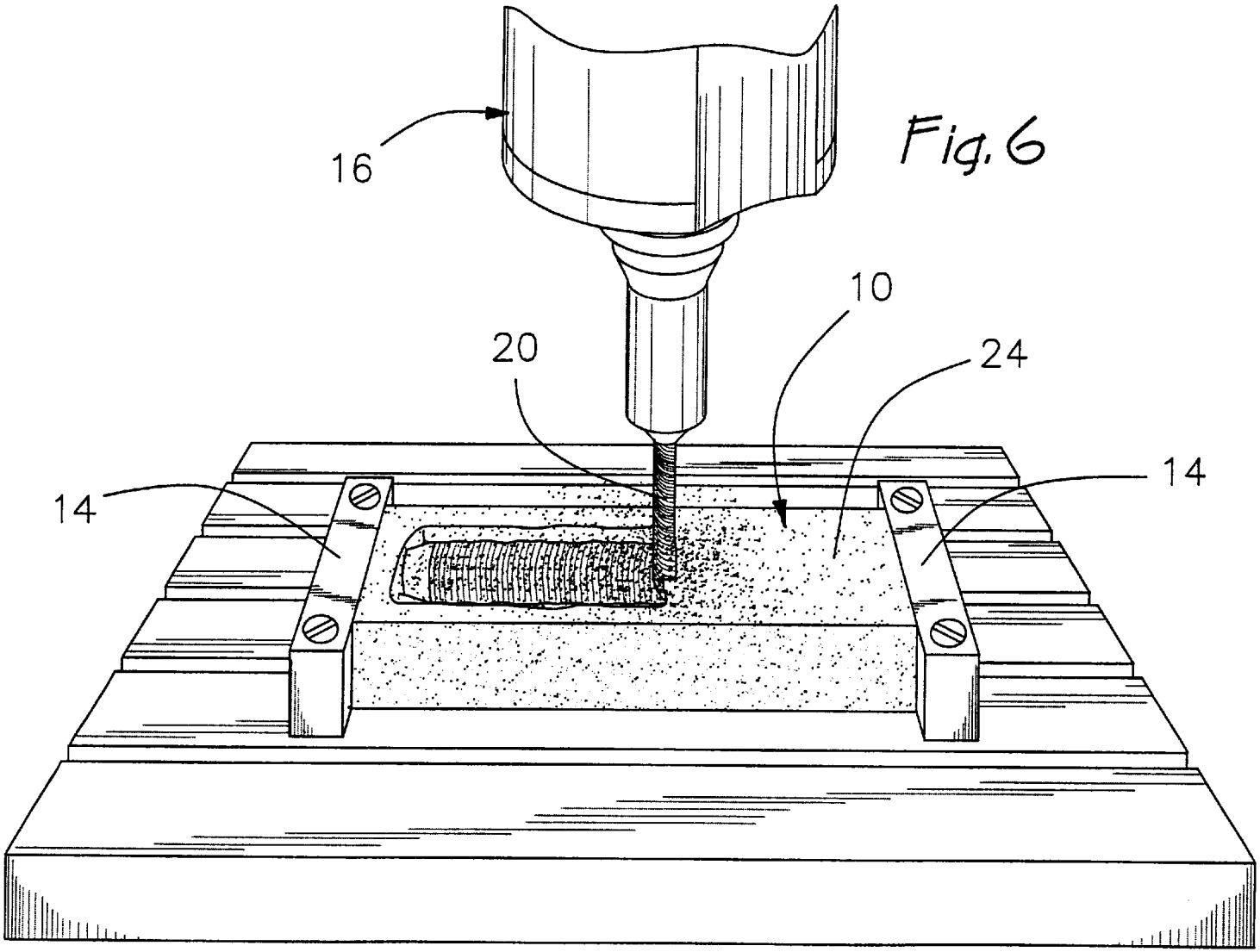
FIG. 6 is a perspective view of the bottom side of the sand block being machined during a roughing operation.
Figure 7:
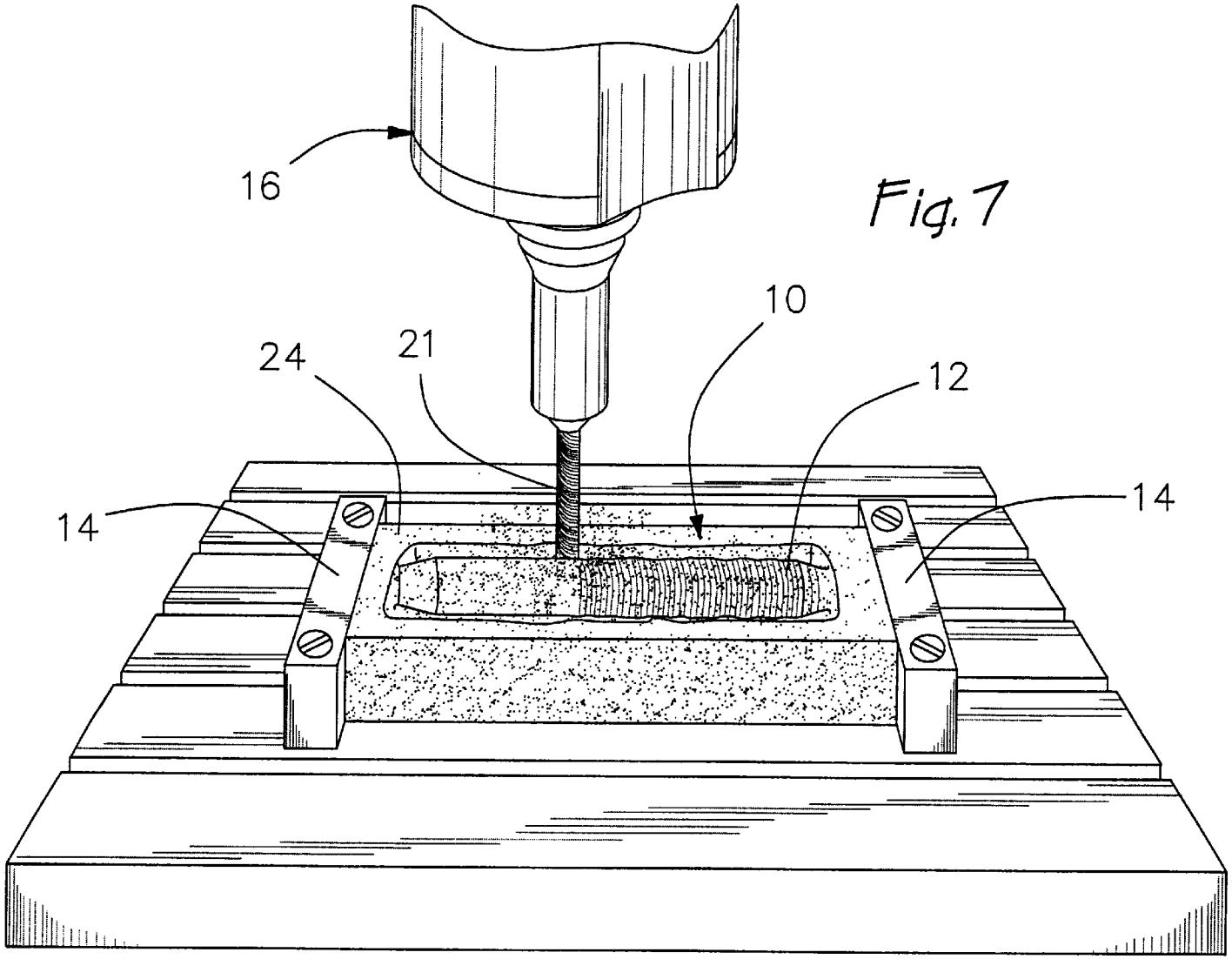
FIG. 7 is a perspective view of the bottom side being machined during a finishing operation.
Figure 8:
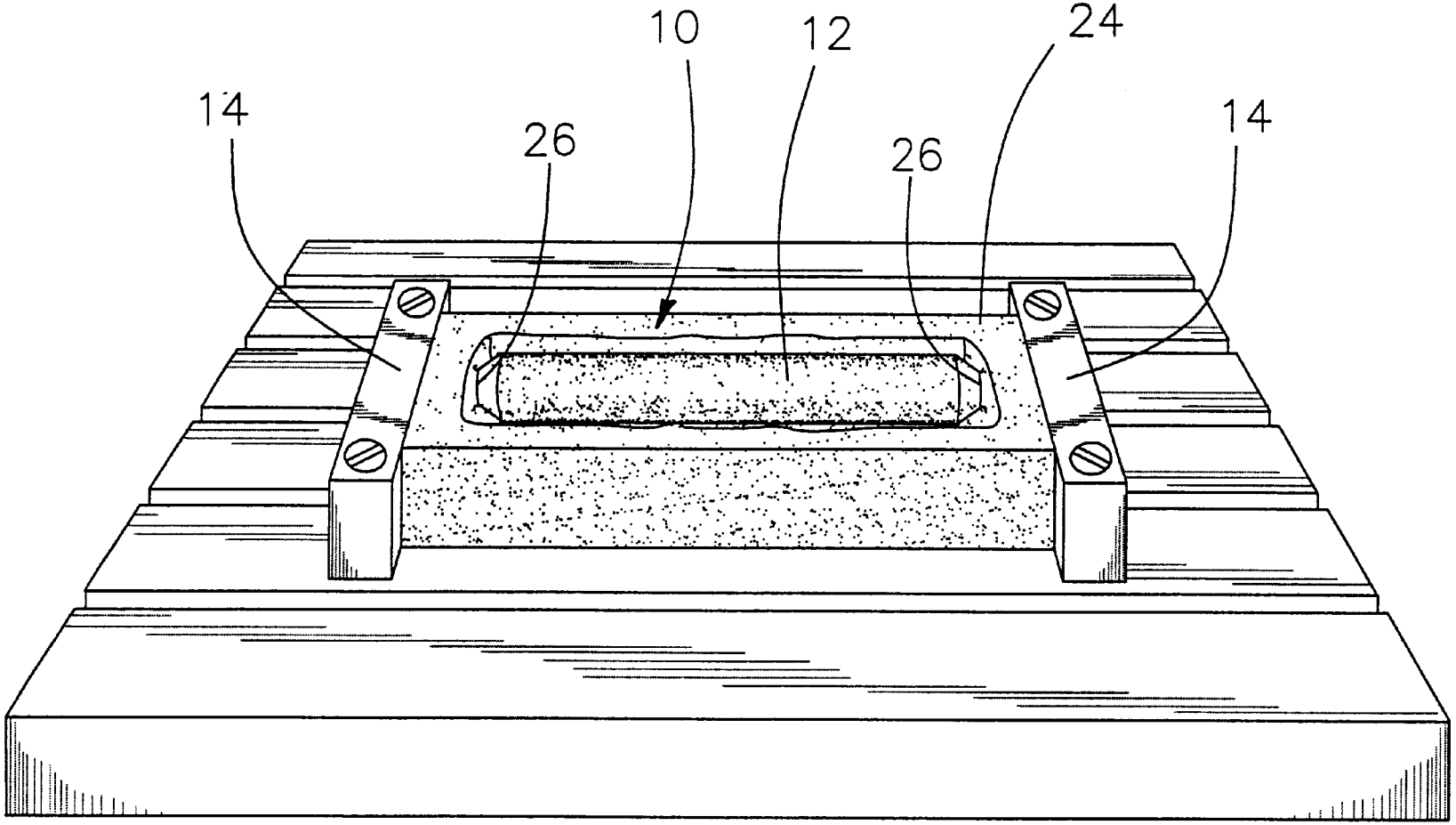
FIG. 8 is a perspective view of the finished core but with the ends of the core still attached to the rest of the sand block.
Figure 9:
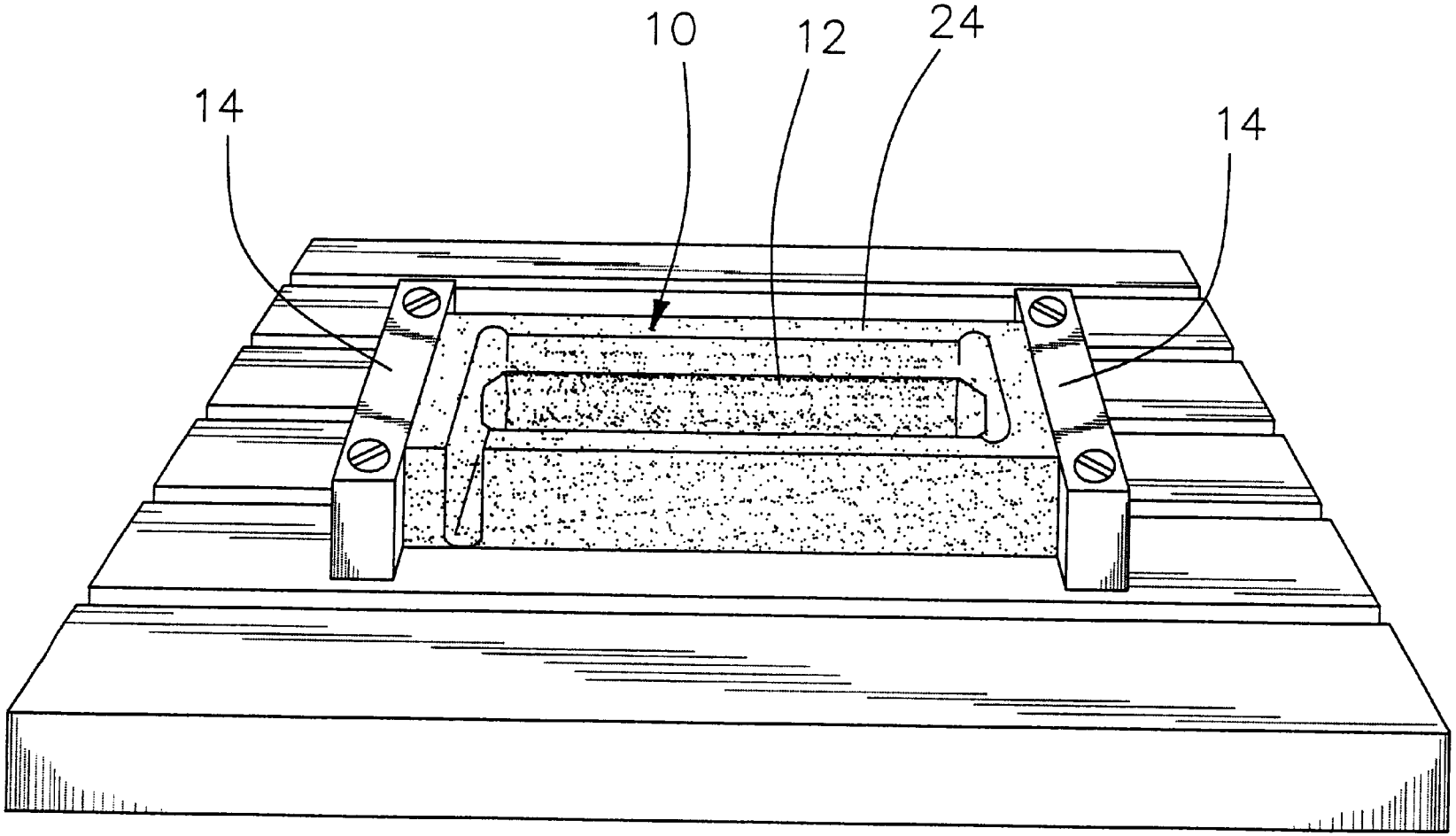
FIG. 9 is a perspective view of the machined sand core with the ends supports removed.
Figure 10:
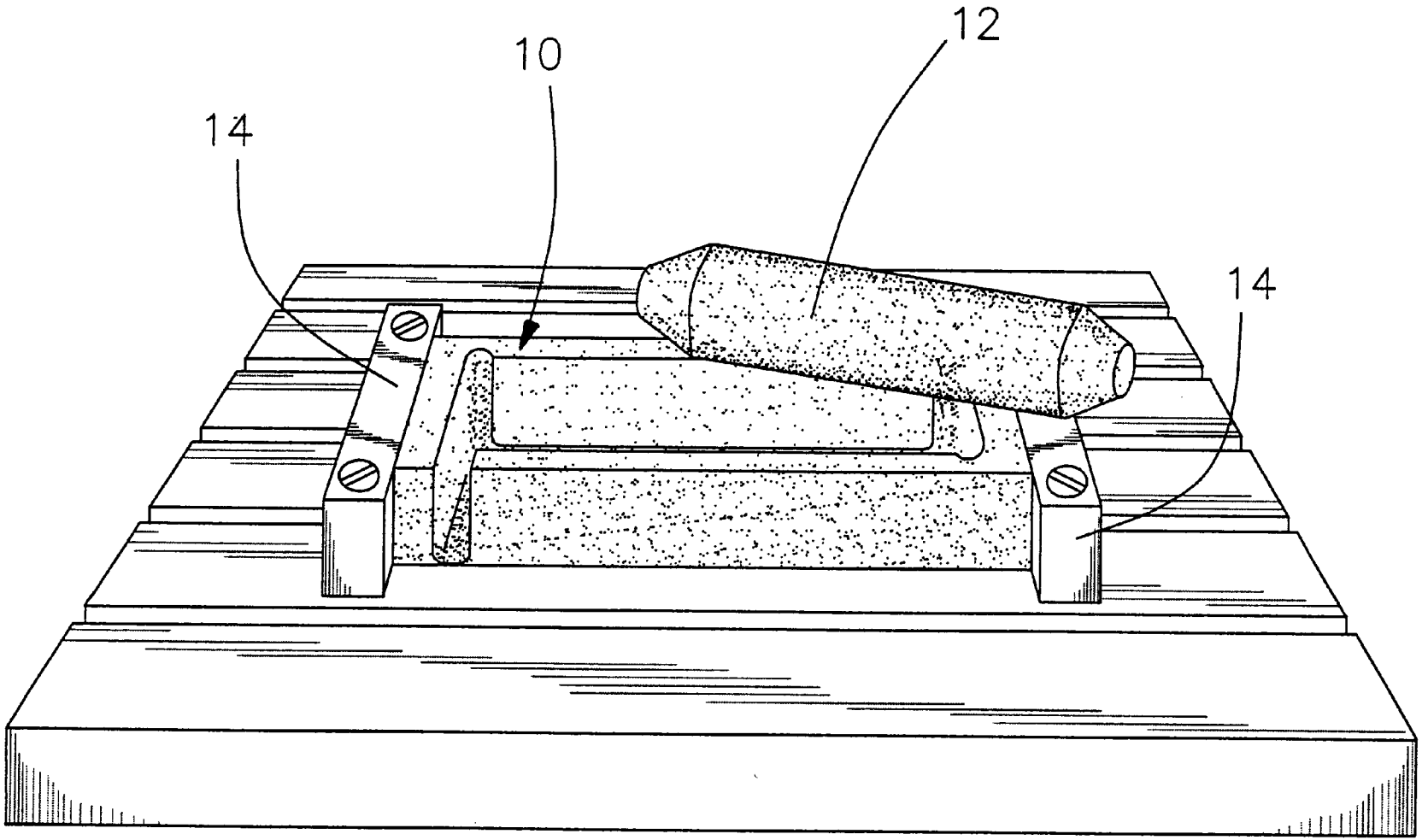
FIG. 10 is a perspective view of the finished sand core removed from the original sand block.

With reference to FIG. 5, the sand block 10 is resecured between clamps 14 with the bottom side 24 facing the cutting tools 20 of the machine tool 16. The locating pins 22 are utilized to reference the bottom side 24 of the sand block 10, such that the pattern formed on the bottom side 24 meets and corresponds to that formed on the top side 18. The bottom side 24 is then machined through a roughing operation with a roughing tool 20 as shown in FIG. 6 and a subsequent finishing operation with a finishing tool 21 as illustrated in FIGS. 7 and 8, similar to that as previously discussed. Once the core is substantially formed as shown in FIG. 8, the ends supports 26 of the core are still attached for the purposes of supporting the core at the same location during all of the previous machining operations. However at this point, the end supports 26 must be removed in order to complete the core 12 to allow it to be removed. As such, the end supports 26 are removed via machining or grinding or other appropriate operation, such that the core 12 becomes free from the rest of the sand block 10. Referring to FIG. 10, the sand core 12 is then removed and can be used in foundry molds to create internal cavities and metal castings.

Once the core 12 is formed, the core 12 can be used as convention in foundry metal casting operations. In particular, the core 12 is set in a mold as conventional, typically between a cope and a drag of the mold. The cope and the drag of the mold may also be formed by the process of the present invention. Multiple sand cores can be inserted into the mold as desired to form the different structural features and cavities in the formed metal casting. Then, molten metal is poured into the mold and allowed to cool and harden. After the requisite time necessary to cool and harden the metal and allow gases to vent through the sand core 12, the sand core 12 is removed from the metal casting during a shake out operation in which the sand core is broken apart by shaking or other conventional operations to overcome the conglomeration forces of the binders and allow the external surface of the metal casting and internal cavities therein to be exposed.

There are several advantages from forming the sand core 12 or other molding elements according to this method. One significant advantage is the fact that the time needed to form molding elements is substantially reduced. The prior art steps of making plastic, wax, wood-like paper, or other prototypes from rapid prototyping processes, and then forming the core box shells to form the mold have been eliminated. Instead, the sand molding elements of the present invention are made directly and simply from the computer readable CAD files or other drawing files that can be used for CNC machining processes. In this manner, the turnaround time for building prototypes and low volume productions is substantially reduced in that sand cores may be formed in a day or less, depending upon the complexity of the casting. Moreover, sand blocks can be formed well in advance prior to the machining operation such that there is no down time in waiting for a sand block to cure or dry, or otherwise be formed suitably to receive molten metal. Another advantage of the present invention is that there is no precision lost due to setting and curing of the sand and binder material. This is because the setting and curing occurs prior to the machining operation and not in the pattern of a core box. By achieving faster turnaround times on metal castings, manufacturers are able to advance through the design more quickly and therefore, are able to get a product that includes a metal casting quicker to the marketplace. Moreover, manufacturers are able to do a substantial amount of testing or verification on the prototype to ensure that the metal casting meets the design requirements specified by the manufacturer or their customer. This eliminates the expense of further design changes which happen after the design is released for production, or is released into the marketplace in which changes at that point can be indeed very expensive.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A method for producing a sand core for interposition between a cope and a drag for use in foundry operations to produce prototype metal castings, comprising:

providing a block of sand held together by binder material; and machining a pattern into the block of sand with at least one machine tool, forming the sand core adapted to be placed between the cope and the drag, the machining step including:

(a) positioning the block of sand in a first position;

(b) machining a first face of the block of sand while in the first position;

(c) positioning the block of sand in a second position different from the first position; and (d) machining a second face of the block of sand while in the second position.

2. The method of claim 1 wherein the step of machining a pattern comprises:

machining the substantially all of the pattern except for at least one support portion connecting the sand core to a waste portion of the block of sand, and thereafter, removing the at least one support portion to release the sand core from the waste portion of the block of sand.

3. The method of claim 1 further comprising:

inputting a computer readable file into an electronic controller of the machine tool, the computer readable file relating to the pattern; and controlling the machine tool using computer numerical control according to said computer readable file to machine the pattern.

4. The method of claim 1 wherein the step of machining a pattern includes the steps of roughing the pattern with a first tool and subsequently finishing the pattern with a second tool.

5. The method of claim 1 wherein the at least one machine tool includes at least one machine tool selected from the group consisting of a drill, a lathe, a grind, and a mill.

6. The method of claim 1 wherein the machine tool uses a cutting bit comprising a cutting edge formed of a material selected from the group consisting of carbide and diamond.

7. The method of claim 1 wherein the two positioning steps comprise clamping the block of sand in the first position and releasing and reclamping the block of sand in the second position.

8. A method for producing a sand core for interposition between a cope and a drag for use in foundry operations to produce prototype metal castings, comprising:

providing a block of sand held together by binder material; and machining a pattern to form a sand core wherein substantially all of the pattern except for at least one support portion connecting the sand core to a waste portion of the block of sand, and thereafter, removing the at least one support portion to release the sand core from the waste portion of the block of sand, the sand core adapted to be placed between the cope and the drag.

9. The method of claim 8 wherein the machining step comprises:

(a) clamping the block of sand in a first position;

(b) machining a first face of the block of sand while in the first position;

(c) releasing and reclamping the block of sand in a second position; and (d) machining a second face of the block of sand while in the second position.

10. The method of claim 8 further comprising:

inputting a computer readable file into an electronic controller of a machine tool, the computer readable file relating to the pattern; and controlling the machine tool using computer numerical control according to said computer readable file to machine the pattern.

11. The method of claim 8 wherein the step of machining includes the steps of roughing the pattern with a first tool and subsequently finishing the pattern with a second tool.

12. The method of claim 8 wherein the step of machining is accomplished with at least one machine tool selected from the group consisting of a drill, a lathe, a grind, and a mill.

13. The method of claim 12 wherein the machine tool uses a cutting bit comprising a cutting edge formed of a material selected from the group consisting of carbide and diamond.

14. A method for producing a metal casting prototype including the formation of a sand core for interposition between a cope and a drag for use in foundry operations, comprising:

providing a block of sand held together by binder material; and machining a pattern into the block of sand with at least one machine tool, thereby forming the sand core;

placing the sand core between a cope and a drag to form a sand mold;

pouring molten metal into the sand mold;

allowing the molten metal to cool to form a metal casting prototype; and breaking the sand mold including the sand core to expose said metal casting prototype wherein the step of machining comprises:

(a) clamping the block of sand in a first position;

(b) machining a first face of the block of sand while in the first position;

(c) releasing and reclamping the block of sand in a second position; and (d) machining a second face of the block of sand while in the second position.

15. A method for producing a metal casting prototype including the formation of a sand core for interposition between a cope and a drag for use in foundry operations, comprising:

providing a block of sand held together by binder material; and machining a pattern into the block of sand with at least one machine tool, thereby forming the sand core;

placing the sand core between a cope and a drag to form a sand mold;

pouring molten metal into the sand mold;

allowing the molten metal to cool to form a metal casting prototype; and breaking the sand mold including the sand core to expose said metal casting prototype wherein the step of machining comprises:

machining substantially all of the pattern except for at least one support portion connecting the sand core to a waste portion of the block of sand, and thereafter, removing the at least one support portion to release the sand core from the waste portion of the block of sand.

16. The method of claim 14 further comprising:

inputting a computer readable file into an electronic controller of the machine tool, the computer readable file relating to the pattern; and controlling the machine tool using computer numerical control according to said computer readable file to machine the pattern.

17. The method of claim 14 wherein the step of machining includes the steps of roughing the pattern with a first tool and subsequently finishing the pattern with a second tool.

18. The method of claim 14 wherein the at least one machine tool includes at least one machine tool selected from the group consisting of a drill, a lathe, a grind, and a mill.

19. The method of claim 14 wherein the machine tool uses a cutting bit comprising a cutting edge formed of a material selected from the group consisting of carbide and diamond.

20. The method of claim 15 further comprising:

inputting a computer readable file into an electronic controller of the machine tool, the computer readable file relating to the pattern; and controlling the machine tool using computer numerical control according to said computer readable file to machine the pattern.

21. The method of claim 15 wherein the step of machining includes the steps of roughing the pattern with a first tool and subsequently finishing the pattern with a second tool.

22. The method of claim 15 wherein the at least one machine tool includes at least one machine tool selected from the group consisting of a drill, a lathe, a grind, and a mill.

23. The method of claim 15 wherein the machine tool uses a cutting bit comprising a cutting edge formed of a material selected from the group consisting of carbide and diamond.

* * * * *